US005957007A

United States Patent [19]

Righini

[11] Patent Number: 5,957,007

[45] **Date of Patent: *Sep. 28, 1999**

[54] SUPPORTING TOOL FOR NAILS, SCREWS AND THE LIKE AND BOX FITTED WITH THE TOOL

[76] Inventor: Giuseppe Righini, Via Sangiorgi 7, 40026 Imola, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/758,029

[22] Filed: Nov. 27, 1996

[30] Foreign Application Priority Data

Dec. 1, 1995 [IT] Italy ..... BO95U0174

[51] Int. Cl.[6] ..... B25C 3/00

[52] U.S. Cl. ..... 81/44; 81/487

[58] Field of Search ..... 81/44, 487, 1, 81/2; 269/3; 294/99.1, 99.2, 1.1; 206/349

[56] References Cited

U.S. PATENT DOCUMENTS

| | | | |
|---|---|---|---|
| 1,715,819 | 6/1929 | Dealy | 81/44 |
| 2,716,750 | 9/1955 | Biblis | 81/44 |
| 4,061,225 | 12/1977 | Pettitt | 206/230 |
| 4,079,764 | 3/1978 | Hayes | 81/44 |
| 4,422,489 | 12/1983 | Ross | 81/44 |
| 4,763,786 | 8/1988 | Benz | 81/487 |
| 5,284,070 | 2/1994 | Rieck | 81/44 |
| 5,321,996 | 6/1994 | Wei | 81/44 |
| 5,375,488 | 12/1994 | Baitner . | |
| 5,671,641 | 9/1997 | Stephenson, Jr. | 81/44 |

FOREIGN PATENT DOCUMENTS

| | | | |
|---|---|---|---|
| 566451 | 4/1958 | Belgium | 81/44 |
| 2315364 | 1/1977 | France | 81/44 |
| 195077 | 2/1908 | Germany | 81/44 |
| 327971 | 10/1920 | Germany | 81/44 |
| 827926 | 12/1951 | Germany . | |
| 1159868 | 12/1963 | Germany | 81/44 |
| 2403851 | 8/1975 | Germany | 81/44 |
| 585964 | 11/1958 | Italy | 81/44 |
| 2124535 | 2/1984 | United Kingdom . | |

*Primary Examiner*—David A. Scherbel
*Assistant Examiner*—Joni B. Danganan
*Attorney, Agent, or Firm*—Stevens, Davis, Miller & Mosher, L.L.P.

[57] ABSTRACT

A supporting tool for nails, screws and the like consists of a body (6) shaped like a plate or slab, in which two openings (7,8) are made; each opening (7,8) being capable of housing a screw or nail (14,15) of different diameter; the sizes of the openings (7,8) vary to define housings for screws or nails of different shapes and diameters; the openings (7,8) extend inside the body (6); the size of the first opening (7) decreases in the opposite direction of the increasing size of the second opening (8); the first opening (7) begins from a first hole (9) and the second opening (8) from a second holes (10); first and second holes (9,10) being capable of housing a nail or screw according to the hole sizes; nails or screws of smaller diameters are clamped by parts of the first or the second openings (7,8) suitable for the diameter of the nail or screw (14,15) to be driven into a wall.

23 Claims, 4 Drawing Sheets

SUPPORTING TOOL FOR NAILS, SCREWS AND THE LIKE AND BOX FITTED WITH THE TOOL

BACKGROUND OF THE INVENTION

The present invention relates to a tool which is used to support nails, screws and the like in order to drive these clamping elements into a wall. In addition, the invention relates to boxes fitted with the tool.

It is known that the operations for driving nails or screws into a wall with hammers or screwdrivers are frequently very dangerous for the operator, especially if not used to performing these operations.

A tool is known allowing the indirect support of a nail, the tool being used to drive into a wall a nail supporting a hook for paintings; the tool represented in FIGS. 1, 2 and 3 essentially consists of a nut at the end of a rod also used as a handle for the tool; the nut is engaged by a narrow annular part of the hook and supports the hook while the nail is driven into the wall.

A tool of this type can only be used for a hook having a narrow annular part with a pre-established diameter; for this reason, a proper tool can be used for each hook size.

AIM OF THE INVENTION

The purpose of this invention is to remedy these disadvantages. The invention, as claimed, solves the problem of creating a supporting tool for nails, screws and the like.

Another purpose of the present invention consists of defining boxes fitted with the above mentioned tool.

The advantages offered by the present invention essentially consist of the fact that the tool is capable of directly supporting nails or screws of various sizes: in addition, the tool is capable of being housed in a box for nails and screws or adhering to the external wall of the box. Therefore, the tool according to the present invention can be used by persons inexperienced with the use of hammers or screwdrivers.

A further advantage is that the tool increases the value of the box housing nails or screws.

BRIEF DESCRIPTION OF THE DRAWINGS

Other advantages, features and aims of the invention may be more readily understood by referring to the accompanying drawings, which concern preferred embodiments of the tool, in which.

DESCRIPTION OF PREFERRED EMBODIMENTS OF THE INVENTION

Figure 1:
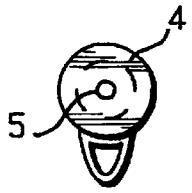
FIG. 1 (PRIOR ART)
FIG. 1 is a frontal view of a hook used to hang a painting on a wall.
Figure 3:
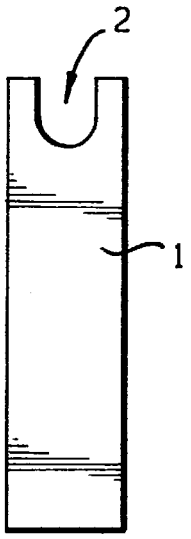
FIG. 3 (PRIOR ART)
FIG. 3 is afrontal view of the tool used for the hook of FIGS. 1, 2.
Figure 2:
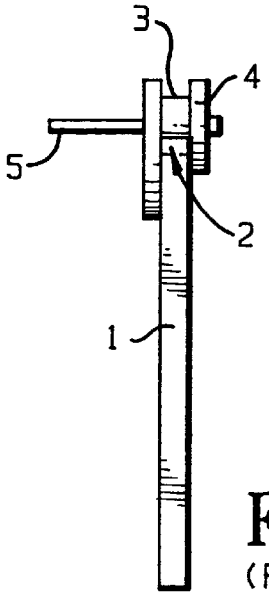
FIG. 2 (PRIOR ART)
FIG. 2 is a lateral view of the hook with a supporting tool.

The known tool shown in FIGS. 1, 2, 3 has already been described briefly; it consists of a body 1 also used as a handle; at an end of the body 1 a groove 2 is provided capable of holding a cylindrical narrow part 3 of a hook 4; a nail 5 is inserted into a hole in the central part of the hook 4 to be supported by the tool. The groove 2 closely fits the cylindrical narrow part 3 of the hook 4, so that the nail 5 is easily driven into the wall.

By examining FIGS. 1, 2, 3 it is possible to understand that the tool can be used for a hook of one size only; in fact, since the groove 2 is shape-retaining, it is suitable for a hook having a narrow part 3 of the same diameter as the groove 2.

Figure 4:
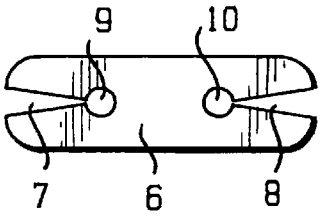
FIGS. 4 to 15, 17 to 21 represent different embodiments of the tool according to the present invention.
Figure 5:
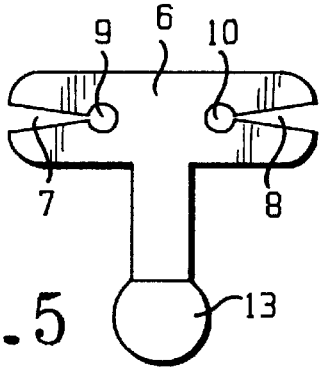

FIGS. 4, 5 show two very similar embodiments of a tool according to the present invention; they only differ in that the tool of FIG. 4 is not fitted with a handle, instead the tool of FIG. 5 presents a handle 13. Apart this little difference, both tools consist of a body formed by a plate or slab in which two openings 7, 8, enlarging from the inside to the outside of the body 6, are provided to define the sizes of the housings for screws or nails of different shapes and diameters.

The opening 7 begins from a first hole 9 while the opening 8 from a second hole 10. The holes 9, 10 are used for housing a nail or screw having diameters compatible with the diameters of the holes 9, 10; nails or screws of smaller diameters are clamped by parts of first or second opening 7, 8 suitable for the diameter of the nail or the screw to be driven into a wall.

The openings 7, 8 present different enlargement angles enlarging from the inside to the outside of the body 6 to define housings for nails or screws of various diameters.

The shapes of the tools of FIGS. 4, 5 and the elasticity of the material they are made of simultaneously allow an enlarging of the opening 7 and a narrowing of the opening 8 as a nail or screw is inserted into the opening 7 (and vice-versa).

Figure 6:
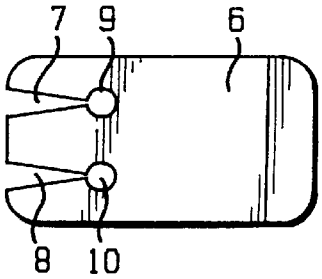

FIG. 6 represents a third embodiment of the tool according to the invention; the body 6 of the tool presents two openings 7, 8 enlarging from the inside to the outside of the body 6 in the same direction to define the sizes of the housings for screws or nails of different shapes and diameters. In this embodiment the openings 7, 8 present different enlargement angles enlarging from inwards outwards of the body 6 to drive nails or screws of different diameters into a wall.

The enlarging and narrowing of the openings 7, 8, due to the inserting of nails or screws into the same openings 7, 8, is more probable than in the tools of FIGS. 4, 5. In addition, this tool is more compact and can be more easily used.

Figure 7:
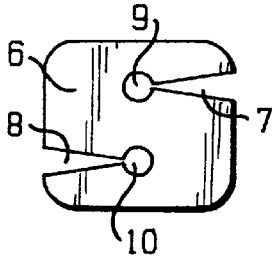

FIG. 7 shows a fourth embodiment of the tool; the body 6 of the tool presents two opposite openings 7, 8 enlarging from the inside to the outside of the body 6; the openings 7, 8 define the sizes of the housings for screws or nails of different shapes and diameters. In this embodiment the openings 7, 8 present different enlargement angles enlarging from the inside to the outside of the body 6 to drive nails or screws of different diameters into the wall.

The simultaneous enlarging of the opening 7 and narrowing of the opening 8, due to the inserting of nails or screws, is very probable while the tool is used; in addition, the tool according to this embodiment is compact, easy to use, not very cumbersome and capable of being housed in a box for nails or screws.

Figure 8:
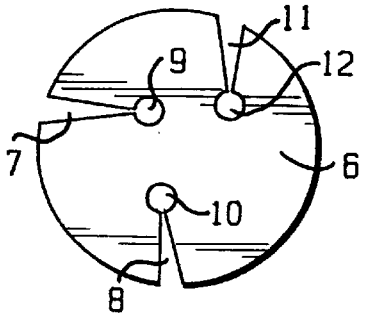
Figure 9:
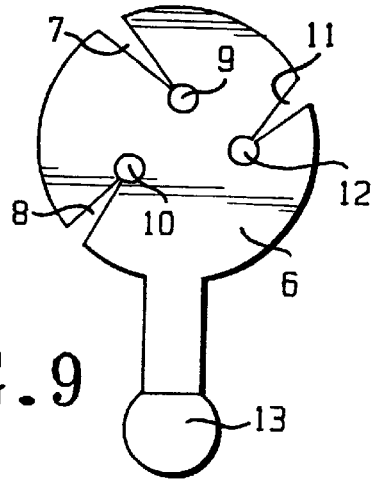

FIGS. 8, 9 show other two very similar embodiments of the tool according to the present invention; they only differ in that the tool of FIG. 8 is not fitted with a handle while the tool of FIG. 9 presents a handle 13. Apart this little difference, both tools consist of a body 6 shaped like a disk in which three openings 7, 8, 11, enlarging from the inside to the outside of the body 6, are provided to define the sizes of the housings for screws or nails of different shapes and diameters.

The opening 7 begins from a first hole 9, the opening 8 from a second hole 10 while the opening 11 originates from a third hole 12. The holes 9, 10, 12 are used for housing a nail or screw of the diameters compatible with the hole sizes; nails or screws of smaller diameters are clamped by parts of the first, second or third openings 7, 8, 11 suitable for the diameters of the nails or screws to be driven into the wall.

The openings 7, 8, 11 present different enlargement angles enlarging from the inside to the outside of the body 6 to drive nails or screws with different diameters. Also in this embodiment the inserting of a screw or nail into one of the openings elastically deforms the others. Owing to this deformation, the nails or screws chosen for the next clamping operations are better held in the other openings.

Figure 10:
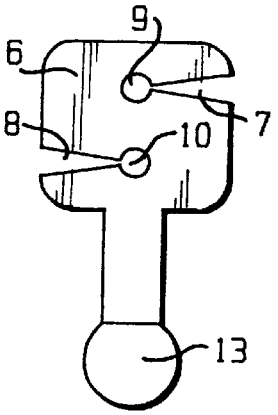

The tool of FIG. 10 is very similar to that of FIG. 7, except for the handle 13.

Figure 11:
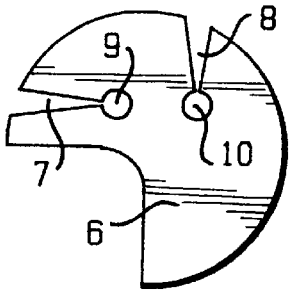

FIG. 11 represents a tool very similar to those of FIGS. 8, 9; in this embodiment two openings 7, 8 are provided in the disk-shaped body 6 enlarging from the inside to the outside of the body 6, to define the sizes of housings for screws or nails of different shapes and diameters. In addition, the openings 7, 8 have edges radiating from the center of the disk-shaped body 6 for an easier manufacture and use.

Figure 12:
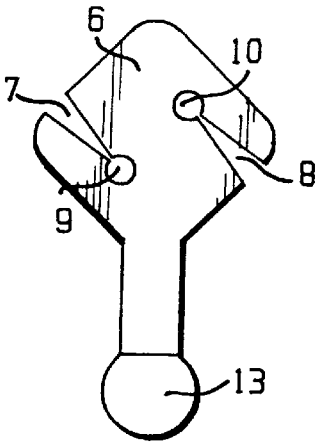

FIG. 12 represents a tool very similar to those of FIGS. 7, 10; the tool being fitted with a handle 13.

Figure 13:
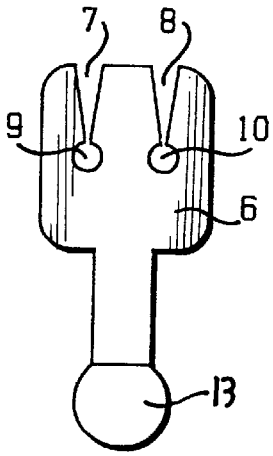

The tool of FIG. 13 is similar to that of FIG. 6 and differs from this for being fitted with a handle 13.

Figure 14:
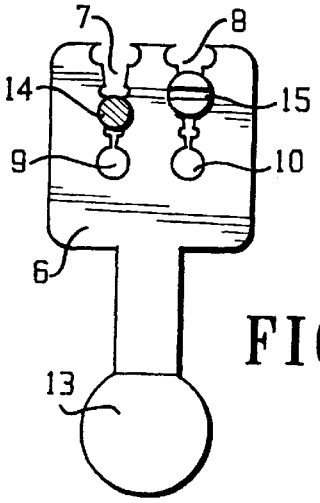

FIG. 14 shows a tool where the openings 7, 8 present saw-shaped contours for more exactly defining housings for nails or screws 14, 15. The semicircular saw-shaped contours present diameters decreasing from the inside to the outside of the body 6; a semicircle on the right contour corresponds to a semicircle of equal diameter on the left contour of each of the openings 7, 8. Therefore, the semicircles have the same function as the holes 9, 10, 12.

Figure 15:
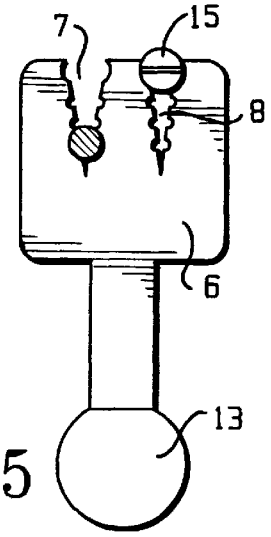

The tool of FIG. 15 is similar to that of FIG. 14, except for the fact that the openings 7, 8 extend from points in the body 6 while the openings 7, 8 of the tool according FIG. 14 begin from holes 9, 10. Adjacent contours of the openings 7,8 on each given side are separated by an area of the tool as shown in FIGS. 14 and 15. The area is not rectilinear, but rather enlarges between respective adjacent openings from the inside to the outside of the tool body as shown in FIGS. 14 and 15.

Each of the tools described with reference to FIGS. 4 to 15 has its particular use according to the available room and or other requirements of the operator. In particular, it seems to be important that one of the openings narrows for clamping a nail or screw when the other opening holds at least one screw or nail. Also the manufacturing costs and overall dimensions with equal efficiency are features which should be taken into consideration for the choice of a tool among those indicated in the above mentioned Figures.

Figure 16:
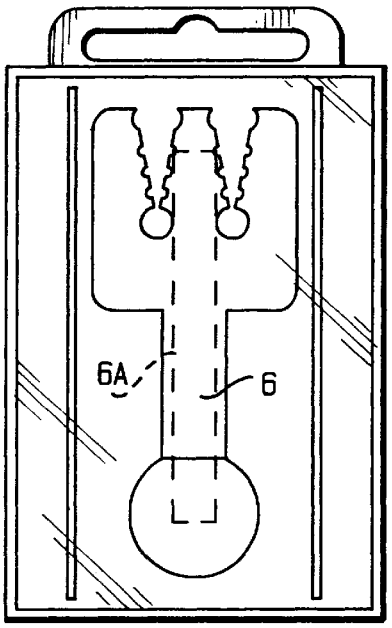
FIG. 16 represents a frontal view of a box fitted with the tool according to the present invention.

FIG. 16 shows a box for nails fitted with a tool according to the present invention; a self-adhesive strip 6A maintains the tool 6 on the external surface of the label-bearer of the box; the tool 6 is partially die-cut so that it is ready for use; it adheres to the box to demonstrate that the same is intact. The purchaser will easily take the tool 6 out off the box label-bearer to use it.

Figure 17:
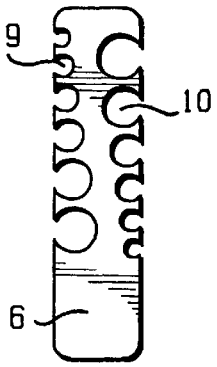

The tool represented in FIG. 17 differs from the previous ones in the fact that the housing holes 9, 10 for nails or screws extend along the lateral edges of the body 6; the housing holes 9, 10 presenting an arced shape. A series of holes 9 extends along the right edge while a series of holes 10 extends along the left edge of the body 6. The diameters of the holes 9 increase from the top downwards; on the contrary, the diameters of the holes 10 decrease from the top downwards. The tool according to this embodiment is more compact and resistant compared to the previous ones.

Figure 18:
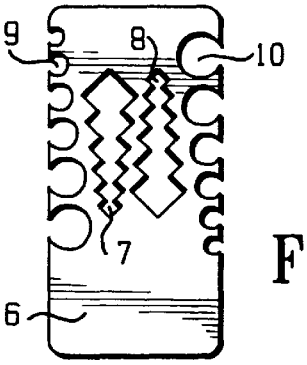

The tool represented in FIG. 18 differs from that of FIG. 17 in that it presents two elongated openings 7, 8 located inside the body 6. The dimension of the opening 7 decreases from the top downwards; on the contrary, the dimension of the openings 8 increases from the top downwards. In addition, both series of holes 9, 10 as in the tool of FIG. 17 are provided along the external edges of the tool.

Figure 19:
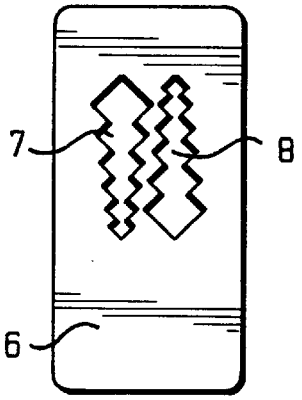

The tool of FIG. 19 presents only two elongated openings 7, 8 located inside the body 6. The dimension of the opening 7 decreases from the top downwards; on the contrary, the dimension of the openings 8 increases from the top downwards.

Figure 20:
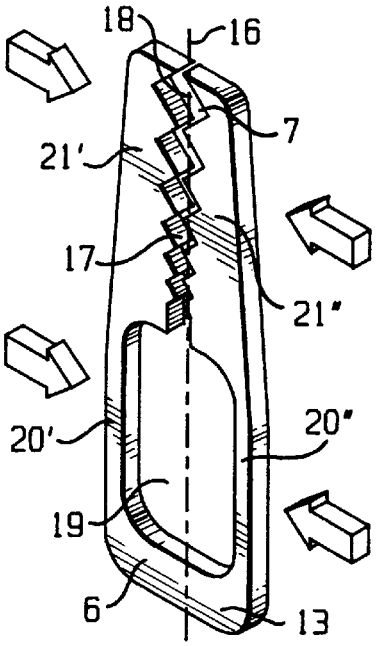

The tool represented in FIG. 20 consists of an open elastic structure forming the body 6; the opening 7 extends along the longitudinal axis 16 of the body 6 and presents an internal saw-shaped edge 17 fitted with a plurality of housings 18 each being capable of holding a nail or screw.

The elasticity of the tool is due to a window 19 provided in the part 13 of the body 6 not taken by the saw-shaped edge 17; the window 19 makes the side walls 20', 20" slender. The part 13 constitutes the tool handle.

The wall 20' is integral with the part 21' delimiting the saw-shaped edge 17 on the left; the wall 20" is integral with the part 21" delimiting the saw-shaped edge 17 on the right.

Once a nail is inserted into the housing 18 suitable for the diameter of the nail to be driven into the wall, the handle 13 is tightened by pressing the side walls 20', 20", so that the housing 18 clamps the nail tightly.

Figure 21:
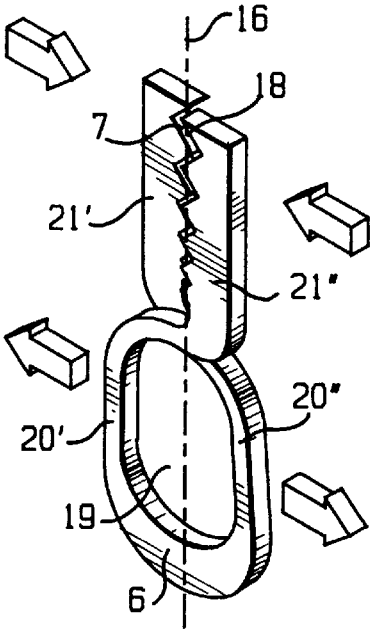

The tool shown in FIG. 21 is similar to that shown in FIG. 20, except that body 6 is formed as a pair of tongs. As will be readily apparent from FIG. 21, when walls 20', 20" are squeezed togather, parts 21', 21" are pushed apart, such that opening 7 is expanded. Afterward, when walls 20',20" are no longer squeezed togather, they tend to separate again, as shown by the lower pair of arrows. As a consequence, parts 21', 21" tend to move togather again, as shown by the upper pair of arrows. Thus, the tool shown in FIG. 21 exibts a clamping action.

I claim:

1. A planar supporting tool for nails or screws, the supporting tool comprising a planar body with a plurality of openings formed in the body, wherein the body has a perimeter, each of the plurality of openings capable of housing nails or screws of different diameters wherein:

each of the openings comprising a first portion and a second portion, the first portion communicates with the second portion, the first portion is a hole located a distance from the body perimeter, the hole having a hole perimeter, the second portion is an angular portion having opposed first and second sides defining an enlargement angle between the sides, respective rays of the respective enlargement angles cross the body perimeter and the hole perimeter and are further apart at the points the rays cross the planar body perimeter than at the points the rays cross the hole perimeter; and each said opening of said plurality of openings having a different enlargement angle from each other said opening to define housings for clamping the nails or screws of the different diameters; wherein:

each hole of the plurality of holes has a respective hole size for housing a nail or screw of a diameter compatible with the hole size, each hole having a hole size different from each other said hole; and each respective opening second portion housing is sized for clamping nails or screws having respective diameters smaller than said respective opening hole size;

each of the housings for clamping the smaller diameters comprises a pair of opposed indentations in the opposed sides, wherein each second portion has a plurality of said housings.

2. A tool as in claim 1, wherein the openings are elongated, said openings being located inside the body.

3. A tool as in claim 2, wherein:

the plurality of openings comprises a first opening and a second opening, the first opening having a size increasing in a first direction and the second opening having a size increasing in a second direction; and the first direction is opposite to the second direction.

4. A tool as in claim 1, wherein:

the body has an edge; and the openings extend along the edge of the body.

5. A tool as in claim 1, wherein:

the plurality of openings comprises a first opening and a second opening; and the body comprises a material having an elasticity which allows an enlarging of the first opening and a simultaneous narrowing of the second opening when a nail or screw is inserted into the first opening or vice-versa.

6. A tool as in claim 1, wherein said opposed sides are saw-toothed.

7. A tool as in claim 1, wherein said indentations are semi-circular indentations, wherein each indentation is separated by a distance from each adjacent indentation on the same side of said respective opening.

8. A tool as in claim 1, wherein said indentations are a plurality of first and second opposed saw-tooth arranged semicircular contours for defining said housings for the nails or screws (14, 15), the saw-tooth arranged semicircular contours present diameters decreasing from the inside to the outside of the planar body (6);

a semicircle on each contour on a first of said opening edges corresponds to an opposed semicircle of equal diameter on a first of said opening edges of the openings (7, 8).

9. A tool as in claim 8, wherein adjacent said semicircular openings on each said side are separated by an area of the tool body, the area is not rectilinear, the respective area between respective adjacent semicircular openings on each said side are larger from the inside to the outside of the tool body.

10. A tool as in claim 1, wherein each opening is elongated and has a longitudinal axis and the respective longitudinal axes are not parallel.

11. A tool as in claim 1, wherein a planar handle lying entirely in the plane of the planar body extends from the planar body.

12. A tool as in claim 1, wherein a portion of said body other than said openings is cut away.

13. A tool as in claim 1, wherein the entire tool lies in a single plane and the tool has a constant thickness.

14. A tool as in claim 1, having an absence of protrusions from said body perimeter.

15. An apparatus comprising the tool of claim 1 and a package with a box for nails or screws, wherein the package contains, in addition to nails or screws, at least one said tool, and the at least one said tool is suitable for holding the nails (14) or screws (15) of the box.

16. An apparatus comprising a box and one or more planar tools, for holding nails or screws, fitted to the box to releasably adhere to a surface of a side of the box and lie solely within the perimeter of said box side, each of said one or more tools comprising a planar body with a plurality of openings formed in the body, each of the plurality of openings capable of housing nails or screws of different diameters, wherein:

each of the openings comprising a first portion and a second portion, the first portion communicates with the second portion, the first portion is a hole located a distance from the body perimeter, the hole having a hole perimeter, the second portion is an angular portion having opposed sides defining an enlargement angle between the sides, respective rays of the respective enlargement angles cross the body perimeter and the hole perimeter and are further apart at the points the rays cross the planar body perimeter than at the points the rays cross the hole perimeter; and each said opening of said plurality of openings having a different enlargement angle from each other said opening to define housings for clamping the nails or screws of the different diameters; wherein:

each of the holes has a hole size for housing a nail or screw of a diameter compatible with the hole size, each hole having a hole size different from each other said hole; and the housings of each respective opening second portion are sized for clamping nails or screws having smaller diameters than said respective opening hole size.

17. An apparatus as in claim 16, wherein the box surface is an external surface of the box; and further comprising a self-adhesive strip which maintains the one or more tools on the external surface of the box.

18. An apparatus as in claim 17, wherein the one or more tools are partially die-cut to be ready for use.

19. An apparatus as in claim 18, wherein the self-adhesive strip is for removably fixing the tool on the external surface of the box.

20. An apparatus as in claim 17, wherein each of the housings for clamping the smaller diameters comprises a plurality of opposed indentations in the opposed sides.

21. An apparatus comprising:

a tool for supporting nails or screws, comprising:

a plate-like body (6), wherein one or more openings (7, 8, 11) are found, each opening (7, 8, 11) being capable of containing nails or screws (14, 15) of different dimensions, and the body (6) is made of an elastic material, which is deformable by stresses acting on the body (6) when the body supports a nail (14) or a screw (15), wherein each opening (7, 8, 11) presents two divergent edges, and every edge has a plurality of indentations, wherein the indentations of the two edges of each opening are opposed.

22. An apparatus of claim 21, wherein said tool consists of:

said plate-like body (6), wherein said one or more openings (7, 8, 11) are found, each opening (7, 8, 11) being capable of containing the nails or screws (14, 15) of different dimensions, and the body (6) is made of said elastic material, which is deformable by stresses acting on the body (6) when the body supports the nail (14) or the screw (15), wherein each opening (7, 8, 11) presents said two divergent edges, and every edge has said plurality of indentations, wherein the indentations of the two edges of each opening are opposed.

23. An apparatus of claim 21, further comprising a package with a box for nails or screws, wherein the package contains, in addition to nails or screws, at least one said tool, and the at least one said tool is suitable for holding the nails (14) or screws (15) of the box.

* * * * *